US005558977A

United States Patent [19]

DePalma et al.

[11] Patent Number: 5,558,977

[45] Date of Patent: Sep. 24, 1996

[54] IMAGING ELEMENT COMPRISING A TRANSPARENT MAGNETIC LAYER AND A TRANSPARENT ELECTRICALLY-CONDUCTIVE LAYER

[75] Inventors: Vito A. DePalma, Rochester; Robert G. Spahn, Webster; Bradley K. Coltrain, Fairport; George N. Musshafen; Sharon R. Girolmo, both of Rochester, all of N.Y.

[73] Assignee: Eastman Kodak Company, Rochester, N.Y.

[21] Appl. No.: 575,786

[22] Filed: Dec. 22, 1995

[51] Int. Cl.[6] ..... G03C 1/85; G03C 1/76

[52] U.S. Cl. ..... 430/496; 430/530; 430/523; 430/140; 430/501; 430/63; 428/694 BS; 428/694 B; 428/694 BG; 428/900

[58] Field of Search ..... 430/140, 63, 530, 430/496, 501, 523; 428/694 BS, 694 B, 694 BG, 900

[56] References Cited

U.S. PATENT DOCUMENTS

| | | | |
|---|---|---|---|
| 4,799,745 | 1/1989 | Meyer et al. | 359/360 |
| 4,837,135 | 6/1989 | Milner | 430/530 |
| 5,147,688 | 9/1992 | Melas | 427/255.3 |
| 5,294,525 | 3/1994 | Yamauchi et al. | 430/523 |
| 5,397,826 | 3/1995 | Wexler | 524/356 |

*Primary Examiner*—Mark F. Huff
*Attorney, Agent, or Firm*—Alfred P. Lorenzo

[57] ABSTRACT

Imaging elements, such as photographic, electrostatographic and thermal imaging elements, are comprised of a support, an image-forming layer, a transparent magnetic layer comprising magnetic particles dispersed in a film-forming binder and a transparent electrically-conductive layer comprising a sputter-deposited layer of a metal oxide. Use of a sputter-deposited metal oxide provides a controlled degree of electrical conductivity and beneficial chemical, physical and optical properties which adapt the electrically-conductive layer for such purposes as providing protection against static or serving as an electrode which takes part in an image-forming process.

20 Claims, No Drawings

IMAGING ELEMENT COMPRISING A TRANSPARENT MAGNETIC LAYER AND A TRANSPARENT ELECTRICALLY-CONDUCTIVE LAYER

FIELD OF THE INVENTION

This invention relates in general to imaging elements, such as photographic, electrostatographic and thermal imaging elements, and in particular to imaging elements comprising a support, an image-forming layer, a transparent magnetic layer, and a transparent electrically-conductive layer. More specifically, this invention relates to transparent electrically-conductive layers which do not require the use of a binder and to the use of such transparent electrically-conductive layers in imaging elements for such purposes as providing protection against the generation of static electrical charges or serving as an electrode which takes part in an image-forming process. The imaging elements include a transparent magnetic layer as well as a transparent electrically-conductive layer so as to provide enhanced performance characteristics.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal from light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. Most of the traditional antistatic systems for photographic applications employ ionic conductors. Charge is transferred in ionic conductors by the bulk diffusion of charged species through an electrolyte. Antistatic layers containing simple inorganic salts, alkali metal salts of surfactants, ionic conductive polymers, polymeric electrolytes containing alkali metal salts, and colloidal metal oxide sols (stabilized by metal salts) have been described previously. The conductivities of these ionic conductors are typically strongly dependent on the temperature and relative humidity in their environment. At low humidities and temperatures, the diffusional mobilities of the ions are greatly reduced and conductivity is substantially decreased. At high humidities, antistatic backcoatings often absorb water, swell, and soften. In roll film, this results in adhesion of the backcoating to the emulsion side of the film. Also, many of the inorganic salts, polymeric electrolytes, and low molecular weight surfactants used are water-soluble and are leached out of the antistatic layers during processing, resulting in a loss of antistatic function.

Colloidal metal oxide sols which exhibit ionic conductivity when included in antistatic layers are often used in imaging elements. Typically, alkali metal salts or anionic surfactants are used to stabilize these sols. A thin antistatic layer consisting of a gelled network of colloidal metal oxide particles (e.g., silica, antimony pentoxide, alumina, titania, stannic oxide, zirconia) with an optional polymeric binder to improve adhesion to both the support and overlying emulsion layers has been disclosed in EP 250,154. An optional ambifunctional silane or titanate coupling agent can be added to the gelled network to improve adhesion to overlying emulsion layers (e.g., EP 301,827; U.S. Pat. No. 5,204,219) along with an optional alkali metal orthosilicate to minimize loss of conductivity by the gelled network when it is overcoated with gelatin-containing layers (U.S. Pat. No. 5,236,818). Also, it has been pointed out that coatings containing colloidal metal oxides (e.g., antimony pentoxide, alumina, tin oxide, indium oxide) and colloidal silica with an organopolysiloxane binder afford enhanced abrasion resistance as well as provide antistatic function (U.S. Pat. Nos. 4,442,168 and 4,571,365).

Antistatic systems employing electronic conductors have also been described. Because the conductivity depends predominantly on electronic mobilities rather than ionicmobilities, the observed electronic conductivity is independent of relative humidity and only slightly influenced by the ambient temperature. Antistatic layers have been described which contain conjugated polymers, conductive carbon particles or semiconductive inorganic particles.

Trevoy (U.S. Pat. No. 3,245,833) has taught the preparation of conductive coatings containing semiconductive silver or copper iodide dispersed as particles less than 0.1 μm in size in an insulating film-forming binder, exhibiting a surface resistivity of $10^2$ to $10^{11}$ ohms per square . The conductivity of these coatings is substantially independent of the relative humidity. Also, the coatings are relatively clear and sufficiently transparent to permit their use as antistatic coatings for photographic film. However, if a coating containing copper or silver iodides was used as a subbing layer on the same side of the film base as the emulsion, Trevoy found (U.S. Pat. No. 3,428,451) that it was necessary to overcoat the conductive layer with a dielectric, water-impermeable barrier layer to prevent migration of semiconductive salt into the silver halide emulsion layer during processing. Without the barrier layer, the semiconductive salt could interact deleteriously with the silver halide layer to form fog and a loss of emulsion sensitivity. Also, without a barrier layer, the semiconductive salts are solubilized by processing solutions, resulting in a loss of antistatic function.

Another semiconductive material has been disclosed by Nakagiri and Inayama (U.S. Pat. No. 4,078,935) as being useful in antistatic layers for photographic applications. Transparent, binderless, electrically semiconductive metal oxide thin films were formed by oxidation of thin metal films which had been vapor deposited onto film base. Suitable transition metals include titanium, zirconium, vanadium, and niobium. The microstructure of the thin metal oxide films is revealed to be non-uniform and discontinuous, with an "island" structure almost "particulate" in nature. The surface resistivity of such semiconductive metal oxide thin films is independent of relative humidity and reported to range from $10^5$ to $10^9$ ohms per square. However, the metal oxide thin films are unsuitable for photographic applications since the overall process used to prepare these thin films is complicated and costly, abrasion resistance of these thin films is low, and adhesion of these thin films to the base is poor.

A highly effective antistatic layer incorporating an "amorphous" semiconductive metal oxide has been disclosed by Guestaux (U.S. Pat. No. 4,203,769). The antistatic layer is prepared by coating an aqueous solution containing a colloidal gel of vanadium pentoxide onto a film base. The colloidal vanadium pentoxide gel typically consists of entangled, high aspect ratio, flat ribbons 50–100 Å wide, about 10 Å thick, and 1,000–10,000 Å long. These ribbons stack flat in the direction perpendicular to the surface when the gel is coated onto the film base. This results in electrical conductivities for thin films of vanadium pentoxide gels (about 1 $\Omega^{31\ 1}cm^{-1}$) which are typically about three orders of magnitude greater than is observed for similar thickness films containing crystalline vanadium pentoxide particles. In addition, low surface resistivities can be obtained with very low vanadium pentoxide coverages. This results in low optical absorption and scattering losses. Also, the thin films are highly adherent to appropriately prepared film bases. However, vanadium pentoxide is soluble at high pH and must be overcoated with a nonpermeable, hydrophobic barrier layer in order to survive processing. When used with a conductive subbing layer, the barrier layer must be coated with a hydrophilic layer to promote adhesion to emulsion layers above. (See Anderson et al, U.S. Pat. No. 5,006,451.)

Conductive fine particles of crystalline metal oxides dispersed with a polymeric binder have been used to prepare optically transparent, humidity insensitive, antistatic layers for various imaging applications. Many different metal oxides—such as ZnO, $TiO_2$, $ZrO_2$, $SnO_2$, $Al_2O_3$, $In_2O_3$, $SiO_2$, MgO, BaO, $MoO_3$ and $V_2O_5$—are alleged to be useful as antistatic agents in photographic elements or as conductive agents in electrostatographic elements in such patents as U.S. Pat. No. 4,275,103, 4,394,441, 4,416,963, 4,418,141, 4,431,764, 4,495,276, 4,571,361, 4,999,276 and 5,122,445. However, many of these oxides do not provide acceptable performance characteristics in these demanding environments. Preferred metal oxides are antimony doped tin oxide, aluminum doped zinc oxide, and niobium doped titanium oxide. Surface resistivities are reported to range from $10^6$–$10^9$ ohms per square for antistatic layers containing the preferred metal oxides. In order to obtain high electrical conductivity, a relatively large amount (0.1–10 g/$m^2$) of metal oxide must be included in the antistatic layer. This results in decreased optical transparency for thick antistatic coatings. The high values of refractive index (>2.0) of the preferred metal oxides necessitates that the metal oxides be dispersed in the form of ultrafine (<0.1 μm) particles in order to minimize light scattering (haze) by the antistatic layer.

Antistatic layers comprising electroconductive ceramic particles, such as particles of TiN, $NbB_2$, TiC, $LaB_6$ or MoB, dispersed in a binder such as a water-soluble polymer or solvent-soluble resin are described in Japanese Kokai No. 4/55492, published Feb. 24, 1992.

Fibrous conductive powders comprising antimony-doped tin oxide coated onto non-conductive potassium titanate whiskers have been used to prepare conductive layers for photographic and electrographic applications. Such materials are disclosed, for example, in U.S. Pat. No. 4,845,369 and 5,116,666. Layers containing these conductive whiskers dispersed in a binder reportedly provide improved conductivity at lower volumetric concentrations than other conductive fine particles as a result of their higher aspect ratio. However, the benefits obtained as a result of the reduced volume percentage requirements are offset by the fact that these materials are relatively large in size such as 10 to 20 micrometers in length, and such large size results in increased light scattering and hazy coatings.

Use of a high volume percentage of conductive particles in an electro-conductive coating to achieve effective antistatic performance can result in reduced transparency due to scattering losses and in the formation of brittle layers that are subject to cracking and exhibit poor adherence to the support material. It is thus apparent that it is extremely difficult to obtain non-brittle, adherent, highly transparent, colorless electro-conductive coatings with humidity-independent process-surviving antistatic performance.

The requirements for antistatic layers in silver halide photographic films are especially demanding because of the stringent optical requirements. Other types of imaging elements such as photographic papers and thermal imaging elements also frequently require the use of an antistatic layer but, generally speaking, these imaging elements have less stringent requirements.

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact, for example, the aqueous alkaline developing solutions used to process silver halide photographic films.

It is well known to include in imaging elements a transparent layer containing magnetic particles dispersed in a binder. Transparent magnetic layers and their use in photographic elements are described, for example, in U.S. Pat. Nos. 3,782,947, 4,279,945, 4,302,523, 4,990,276, 5,217,804, 5,252,441 and 5,254,449, in European Patent Application No. 0 459 349, published Dec. 4, 1991, and in *Research Disclosure,* Item 34390, November, 1992. However, to provide both effective magnetic properties and effective electrical conductivity characteristics in an imaging element, without impairing its imaging characteristics, poses considerable technical difficulty.

Since both electrically-conductive layers and transparent magnetic layers contribute to haze, it is extremely difficult to prepare an imaging element containing both of these layers which meets stringent optical requirements. This is especially the case where the transparent magnetic layer also contains abrasive particles, as described for example in U.S. Pat. No. 5,397,826, since the abrasive particles also contribute significantly to the formation of haze. Thus, many of the antistatic layers of the prior art are not acceptable for use in imaging elements which include one or more transparent magnetic layers.

It is toward the objective of providing both magnetic layers and electrically-conductive layers that more effectively meet the diverse needs of imaging elements—especially of silver halide photographic films but also of a wide range of other imaging elements—than those of the prior art that the present invention is directed.

SUMMARY OF THE INVENTION

The present invention pertains to imaging elements which exhibit excellent magnetic performance as well as having a high degree of transparency and a high degree of electrical conductivity. More specifically, the present invention pertains to an imaging element for use in an image-forming process which comprises a support, an image-forming layer, a transparent magnetic layer comprising magnetic particles dispersed in a film-forming binder, and a transparent electrically-conductive layer comprising a sputter-deposited layer of a metal oxide. Preferably, the transparent magnetic layer provides a coverage of magnetic particles in the range of from about 0.001 $g/m^2$ to about 10 $g/m^2$, and more preferably in the range of from about 0.01 $g/m^2$ to about 1 $g/m^2$ and preferably the transparent electrically-conductive layer has a thickness of less than 50 nanometers and more preferably less than 15 nanometers.

The imaging elements of this invention can contain one or more image-forming layers, one or more transparent magnetic layers, and one or more transparent electrically-conductive layers and such layers can be coated on any of a very wide variety of supports. Use of a sputter-deposited metal oxide layer enables the preparation of an extremely thin, highly conductive, transparent layer which is strongly adherent to photographic supports and can be readily treated, such as by use of conventional subbing layers, to adhere to overlying layers such as emulsion layers, pelloids, topcoats, backcoats, and the like. The electrical conductivity provided by the conductive layer of this invention is independent of relative humidity and persists even after exposure to aqueous solutions with a wide range of pH values (i.e., $2 \leqq pH \leqq 13$) such as are encountered in the processing of photographic elements.

The transparent magnetic layer can be positioned in an imaging element in any of various positions. For example, it can overlie one or more image-forming layers, or underlie one or more image-forming layers, or be interposed between image-forming layers, or serve as a subbing layer for an image-forming layer, or be coated on the side of the support opposite to the image-forming layer. A typical thickness for the transparent magnetic layer in the imaging elements of this invention is in the range of from about 0.05 to about 10 micrometers. Use, in combination with a sputter-deposited metal oxide layer, of a transparent magnetic layer in which the magnetic particles are cobalt-modified $\gamma$-iron oxide particles provides particularly excellent performance.

In a particular embodiment of this invention, the transparent magnetic layer is formed from a dispersion comprising magnetic particles, a dialkyl ester of phthalic acid and a dispersing agent as described in Bishop et al, U.S. Pat. No. 4,990,276, issued Feb. 5, 1991.

In a further particular embodiment of this invention, the transparent magnetic layer is formed from magnetic particles which are cobalt surface treated gamma iron oxide particles having a specific surface area of at least 30 $m^2/g$ and a powder coercivity of greater than about 450 Oe and being coated with from about 10 to about 50% by weight of a material having a refractive index less than that of the binder as described in James et al, U.S. Pat. No. 5,252,441, issued Oct. 12, 1993.

In yet another particular embodiment of this invention, the transparent magnetic layer contains abrasive particles as described in Wexler, U.S. Pat. No. 5,397,826, issued Mar. 14, 1995.

Imaging elements in accordance with this invention can be advantageously prepared by use of the process described in James et al, U.S. Pat. No. 5,254,449, issued Oct. 19, 1993, in which a magnetic dispersion is co-cast with a cellulose organic acid ester solution.

It is well known to form an electrically-conductive layer by dispersing metal oxide particles in a film-forming polymeric binder and coating the dispersion in the form of a thin layer. The use of such electrically-conductive layers in photographic elements which include a transparent magnetic layer is disclosed, for example, in U.S. Pat. No. 5,294,525. However, the present invention is highly advantageous in comparison to the use of such particulate metal oxide layers in that the sputter-deposited metal oxide layer of this invention requires no binder and therefore can be made much thinner, and thus much less detrimental to the optical characteristics of the element. As hereinabove described, in a preferred embodiment of the invention, the sputter-deposited metal oxide layer has a thickness of less than 50 nanometers, and in a particularly preferred embodiment of less than 15 nanometers.

The use of sputter-deposited metal oxide layers in imaging elements, in accordance with this invention, provides numerous advantages. Thus, for example, because the layer is continuous rather than particulate, it is highly transparent and makes little or no contribution to haze. The sputter-deposited layer adheres well to the types of supports that are used in imaging elements and usually does not require prior surface treatment of the support, such as glow discharge treatment, that may be required with some electrically-conductive layers of the particle/binder type. The combination of a high degree of electrical conductivity and a high degree of transparency that is readily obtainable with a sputter-deposited metal oxide layer is generally not achievable with layers of the particle/binder type since if a very high particle to binder ratio is used to give a high degree of electrical conductivity it results in poor transparency. An additional advantage of sputter-deposited conductive layers is elimination of the need for organic solvents that are often needed with particle/binder compositions.

A further important advantage of using a sputter-deposited metal oxide layer rather than a layer comprised of particles of metal oxide dispersed in a binder is that the particulate layer can cause serious difficulties in such manufacturing operations as slitting and perforating since the abrasive metal oxide particles cause rapid wear of slitters and punches. This problem is especially severe in imaging elements which contain a transparent magnetic layer since the abrasive magnetic particles contribute to the same problem and a particulate antistatic agent which further aggravates the problem is highly undesirable. The problem is effectively avoided with sputter-deposited metal oxide layers which can be extremely thin and do not contribute significantly to the wear of slitters and punches.

DESCRIPTION OF THE PREFERRED EMBODIMENTS

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum-paper laminate, (b) metal plates, e.g., aluminum, copper, zinc, brass, etc., (c) metal foils such as aluminum foil, zinc foil, etc., (d) vapor deposited metal layers such as silver, aluminum, nickel, etc., (e) semiconductors dispersed in resins such as poly(ethylene terephthalate) as described in U.S. Pat. No. 3,245,833, (f) electrically conducting salts such as described in U.S. Pat. Nos. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, *Research Disclosure,* June 1978, Item No. 17029; U.S. Pat. No. 3,457,075; U.S. Pat. No. 3,933,508; and U.S. Pat. No. 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R. W. Gundlach, "Xeroprinting Master with Improved Contrast Potential", *Xerox Disclosure Journal,* Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng, and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force.

An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R. M. Schaffert, *Electrophotography,* (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non-photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing step may also be needed, depending on the exposure levels.

Another example of imaging elements which employ an antistatic layer are dye-receiving elements used in thermal dye transfer systems.

Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. No. 4,621,271.

In EPA No. 194,106, antistatic layers are disclosed for coating on the back side of a dye-receiving element. Among the materials disclosed for use are electrically-conductive inorganic powders such as a "fine powder of titanium oxide or zinc oxide."

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. No. 4,343,880 and 4,727,008.

In the imaging elements of this invention, the image-forming layer can be any of the types of image-forming layers described above, as well as any other image-forming layer known for use in an imaging element.

All of the imaging processes described hereinabove, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

As described hereinabove, the imaging elements of this invention include at least one transparent electrically-conductive layer comprised of sputter-deposited metal oxide.

A preferred metal oxide for forming a transparent sputter-deposited electrically-conductive layer in an imaging element is indium tin oxide (ITO). Other metal oxides, such as, for example, zinc oxide or aluminum-doped zinc oxide, can be used in place of ITO. Technical information pertaining to such metal oxides is available, for example, in *Handbook of Thin Film Process Technology,* Editors David A. Glocker and Slsmat Shah, Institute of Physics Publishing, Bristol and Philadelphia, 1995.

Methods and apparatus for sputter-depositing metal oxides are well known in the art. Thus, for example, the metal oxide layer can be prepared by conventional thin film deposition techniques such as RF (radio frequency) and DC (direct current) sputtering from a suitable target composed of the metal oxide. Enhancement of the sputtering process by application of a magnetic field (magnetron sputtering) can also be employed to provide a layer with particularly good characteristics. Ion-assisted sputtering can be used to provide enhanced deposition speed.

The electrically-conductive properties of a thin film of sputter-deposited metal oxide can be improved by preheating the support or by annealing the coated support in air at elevated temperatures. The latter technique will incorporate oxygen into the sputter-deposited layer and thereby increase its conductivity. This will permit the use of thinner layers and thereby reduce deposition time.

Conductive films which are composed of a polymer support having thereon a sputter-deposited layer of ITO are commercially available. For example, SOUTHWALL TECHNOLOGIES supplies transparent conductive films under the trademark ALTAIR-O which are produced by sputter coating a thin layer of ITO on a polyester substrate. Applications for such conductive films include touch panel switches, liquid crystal display, liquid crystal windows, electroluminescent lamps, transparent heaters, electrochromic devices and electrostatic discharge control. Such commercially available conductive films can be utilized in preparing the imaging elements of this invention.

In the imaging elements of this invention, the sputter-deposited metal oxide layer can be of any desired thickness, but is generally an extremely thin layer when optical requirements are severe so as to contribute as little as possible to degradation of optical characteristics. It is an important advantage of this invention that sputter-deposited metal oxide layers can be very much thinner than layers that comprise metal oxide particles dispersed in a binder. Preferred imaging elements within the scope of this invention have a sputter-deposited metal oxide layer with a thickness of less than 50 nanometers and more preferably less than 15 nanometers.

For the preparation of photographic films, any of a wide variety of film supports can be used. Suitable film supports include polyethylene terephthalate, polyethylene naphthalate, polycarbonate, polystyrene, cellulose nitrate, cellulose acetate, cellulose acetate butyrate, cellulose acetate propionate, and laminates thereof. To promote adhesion, film supports can be surface treated by various processes including corona discharge, glow discharge, UV exposure and solvent washing or overcoated with polymers such as vinylidene chloride containing copolymers, butadiene-based copolymers, glycidyl acrylate or methacrylate containing copolymers, or maleic anhydride containing copolymers.

In using a sputter-deposited metal oxide layer as an antistatic layer of a photographic element, any of various layer configurations can be employed. Where needed, subbing layers conventionally employed in the photographic art can be applied to the sputter-deposited metal oxide layer to promote adhesion of overlying layers. In the case of photographic elements for graphics arts application, the antistatic layer can be applied to a polyester film base during the support manufacturing process, after orientation of the cast resin, on the film base itself or on top of a polymeric undercoat layer. The antistatic layer can be applied as a subbing layer under the sensitized emulsion, on the side of the support opposite the emulsion or on both sides of the support. Alternatively, the antistatic layer can be applied as part of a multi-component curl control layer on the side of the support opposite to the sensitized emulsion. The antistatic layer would typically be located closest to the support. An intermediate layer, containing primarily binder and antihalation dyes functions as an antihalation layer. The outermost layer containing binder, matte, and surfactants functions as a protective overcoat. Other addenda, such as polymer lattices to improve dimensional stability, hardeners or crosslinking agents, and various other conventional additives can be present optionally in any or all of the layers other than the electrically-conductive layer.

In the case of photographic elements for direct or indirect x-ray applications, the antistatic layer can be applied as a subbing layer on either side or both sides of the film support. In one type of photographic element, the antistatic subbing layer is applied to only one side of the film support and the sensitized emulsion coated on both sides of the film support. Another type of photographic element contains a sensitized emulsion on only one side of the support and a pelloid containing gelatin on the opposite side of the support. An antistatic layer can be applied under the sensitized emulsion or, preferably, the pelloid. Additional optional layers can be present. In another photographic element for x-ray applications, an antistatic subbing layer can be applied either under or over a gelatin subbing layer containing an antihalation dye or pigment.

Polyester films are commonly utilized in photographic elements because their dimensional stability characteristics are unsurpassed. However, because of the difficulty of achieving strong bonding of overlying hydrophilic colloid layers to such films, it is usually necessary to employ a latex subbing layer between a polyester film support and the overlying photographic layer, such as a silver halide emulsion layer or a backing layer. Latex subbing layers used to promote the adhesion of coating compositions to polyester film supports are very well known in the photographic art. Useful compositions for this purpose include interpolymers of vinylidene chloride such as vinylidene chloride/acrylonitrile/acrylic acid terpolymers or vinylidene chloride/methyl acrylate/itaconic acid terpolymers. Such compositions are described in numerous patents such as, for example, U.S. Pat. Nos. 2,627,088, 2,698,235, 2,698,240, 2,943,937, 3,143,421, 3,201,249, 3,271,178, 3,443,950 and 3,501,301. The latex subbing layer is typically overcoated with a second subbing layer comprised of gelatin which is typically referred to in the art as a "gel sub." Functional layers, such as silver halide emulsion layers containing gelatin or other hydrophilic colloid as a binder, are then applied over the gel sub layer. Such latex subbing layers, with or without a gel sub layer, can be coated over the sputter-deposited metal oxide layer in the imaging elements of this invention in order to promote adhesion of overlying layers.

As indicated hereinabove, transparent magnetic layers are well known in the art and are described in numerous references such as U.S. Pat. Nos. 3,782,947, 4,279,945, 4,302,523, 4,990,276, 5,217,804, 5,252,441, 5,254,449, European Patent Application No. 0 459 349 and *Research Disclosure,* Item 34390, November, 1992, the disclosures of which are incorporated herein by reference. As disclosed in these publications, the magnetic particles can consist of ferro- or ferrimagnetic oxides, complex oxides including other metals, metallic alloy particles with protective coatings, ferrites, hexaferrites, etc. and can exhibit a variety of particulate shapes, sizes, and aspect ratios. The magnetic particles optionally can contain a variety of dopants and can be overcoated with a shell of particulate or polymeric material. The conductive metal oxide layer can be located beneath the magnetic layer as a subbing layer, overlying the magnetic layer as a backcoat or can be on the opposite side of the support from the magnetic layer underlying an emulsion layer or a layer containing antihalation dyes or pigments as a subbing layer. The location of the conductive metal oxide layer is not limited to the specific configurations described herein. Additional functional layers may be present including but not limited to abrasion resistant and other protective layers, abrasive-containing layers, adhesion-promoting layers, lubricant layers, and other magnetic layers for purposes such as improving web conveyance, optical properties, physical performance, and durability.

As is well known in the art, abrasive particles can be included in the transparent magnetic layer. Examples of the abrasive particles include non-magnetic inorganic powders with a Mohs scale hardness of not less than 6, preferably not less than 8. The abrasive particles have an average diameter of from about 0.04 to about 0.4 μm and preferably an average diameter of from about 0.06 to about 0.35 μm. Specific examples are metal oxides such as aluminum oxides, such as, alpha-alumina, corundum, chromium oxide ($Cr_2O_3$), iron oxide (alpha $Fe_2O_3$), tin oxide, doped tin oxide, such as antimony or indium doped tin oxide, silicon dioxide and titanium dioxide, carbides such as silicon carbide and titanium carbide; and diamond in fine powder form.

Imaging elements incorporating conductive layers of this invention that are useful for other specific applications such as color negative films, color reversal films, black-and-white films, color and black-and-white papers, electrophotographic media, thermal dye transfer recording media etc., can also be prepared by the procedures described hereinabove.

The present invention is further illustrated by the following examples of its practice. In these examples, reference is made to dry adhesion, wet adhesion, visible $D_{min}$, UV $D_{min}$ and surface resistivity. Dry adhesion is determined by cutting the coating in a cross-hatched pattern with a razor blade, applying a piece of SCOTCH® brand 610 adhesive tape, removing the tape and qualitatively determining the amount of coating removed by the tape. To evaluate wet adhesion, the sample is cut into 35 mm by 12.7 cm strips and soaked in a photographic developing solution (to simulate photoprocessing conditions) for 3 minutes and 15 seconds at 38° C. The sample is scribed in the width direction and placed in an abrasion apparatus with developing solution covering the sample. The abrasion apparatus includes an arm having a rubber pad about 3.5 cm in diameter attached to its end. A 900 gram weight is applied to the arm and the pad is rubbed perpendicularly to the scribed line for 100 cycles at a speed of 60 cycles per minute. Three replicates are run for each test. Visible $D_{min}$ refers to minimum density in the visible region of the spectrum and UV $D_{min}$ refers to minimum density in the ultraviolet region. These values are determined with the use of a densitometer. The surface resistivity (SER) of the sputter-deposited metal oxide layer was measured with the use of a two-point probe method as described in U.S. Pat. No. 2,801,191 and is reported in ohms per square.

EXAMPLES 1–5

Transparent electrically-conductive layers were prepared by sputtering of an indium tin oxide (ITO) target at low power (100 watts) with 5 mTorr of argon as the backfill gas. The layers were deposited directly onto a polyethylene terephthalate film support without any prior treatment. To provide an adhesion-promoting overlayer, an aqueous latex solution of a terpolymer of acrylic acid (6%), vinylidene chloride (80%) and acrylonitrile (14%) was prepared at a concentration of 0.25 weight percent and a surfactant was added at 0.1 weight percent. The solution was handcoated on the ITO layer using a standard wire-wrapped coating rod to provide a dry coverage of 0.053 g/m$^2$ of the terpolymer. The coating was dried on a coating block for a minute at 60° C. and then further dried in a convection oven at 100° C. for 5 minutes. The adhesion-promoting layer was subjected to the dry adhesion and wet adhesion tests and in both tests there was essentially no removal of the coating.

The adhesion-promoting layer was overcoated with a transparent magnetic layer. The coating composition used to form the transparent magnetic layer was as follows:

| Component | Weight % |
|---|---|
| Cellulose diacetate | 2.85 |
| Gamma ferric oxide particles | 0.13 |
| Cellulose triacetate | 0.13 |
| Dibutylphthalate | 0.1547 |
| Surfactant* | 0.015 |
| Dispersant** | 0.0059 |
| Gamma alumina | 0.117 |
| Solvent*** | 96.59 |

*FC-431 nonionic fluorinated alkyl ester surfactant available from Minnesota Mining and Manufacturing Company
**SOLSPERSE 2400 polyalkyleneimine dispersant available from Zeneca Corporation
***A mixture of 70% methylene chloride, 25% acetone and 5% methyl acetoacetate The magnetic coating composition was handcoated on a 20° C. coating block using a standard wire-wrapped coating rod to provide 1.056 g/m$^2$ dry coverage. After coating, the block was heated to 42° C. for 1 minute followed by final drying in an oven at 100° C. for 5 minutes. The magnetic layer was subjected to the dry adhesion and wet adhesion tests and in both tests there was essentially no removal of the coating.

Visible density, UV density and SER measurements were made on the above-described elements and the results obtained are reported in Table I below. Initial values reported in Table I are those determined before application of the transparent magnetic layer while final values are those determined after application of the transparent magnetic layer.

TABLE I

| Example No. | ITO Thickness (nanometers) | Initial Visible Dmin | Initial UV Dmin | Initial SER | Final Visible Dmin | Final UV Dmin | Final SER |
|---|---|---|---|---|---|---|---|
| 1 | 13.4 | 0.036 | 0.101 | $0.47 \times 10^5$ | 0.063 | 0.183 | $1.25 \times 10^4$ |
| 2 | 15.1 | 0.029 | 0.088 | $0.71 \times 10^4$ | 0.079 | 0.243 | $0.73 \times 10^4$ |
| 3 | 15.1 | 0.027 | 0.087 | $0.99 \times 10^4$ | 0.067 | 0.194 | $1.7 \times 10^4$ |
| 4 | 40.2 | 0.126 | 0.243 | $0.58 \times 10^4$ | 0.136 | 0.351 | $0.3 \times 10^4$ |
| 5 | 38.4 | 0.126 | 0.245 | $0.98 \times 10^4$ | 0.133 | 0.321 | $0.42 \times 10^4$ |

The data reported in Table I demonstrate that sputter-deposited ITO provides a combination of good transparency and good electrical conductivity as is required for image-forming elements. Similar results can be obtained using other conductive metal oxides in place of ITO.

For purposes of comparison, electrically-conductive layers were prepared from an aqueous coating composition comprising ITO particles and a polymer binder. In Comparative Example A, the ITO particles were coated at a weight ratio of particle to binder of 85:15 and with a coverage of 237 mg/m$^2$ and the SER value was $1.3\times10^7$ ohms/square. In Comparative Example B the ITO particles were coated at a weight ratio of particle to binder of 85:15 and with a coverage of 168 mg/m$^2$ and the SER value was $2.0\times10^8$ ohms/square.

Comparing the data in Table I with Comparative Examples A and B, it is seen that the sputter-deposited ITO provided electrical-conductivity which is three to four orders of magnitude greater than the particulate ITO. A sputter-deposited ITO layer at a thickness of 15 nanometers is an order of magnitude thinner layer than a typical particulate ITO layer and thus represents a much more efficient use of ITO.

EXAMPLES 6–9

In these examples, the ITO was sputter-deposited over the transparent magnetic oxide layer. The visible density and SER values achieved are summarized in Table II.

TABLE II

| Example No. | ITO Thickness (nanometers) | Visible Dmin | SER |
|---|---|---|---|
| 6 | 18.5 | 0.084 | $2.6\times10^{10}$ |
| 7 | 25.2 | 0.132 | $1.7\times10^{4}$ |
| 8 | 43.2 | 0.179 | $6.9\times10^{3}$ |
| 9 | 63.1 | 0.201 | $7.2\times10^{3}$ |

As shown by the data in Table II, much better results with regard to electrical conductivity are achieved with the thicker sputter-deposited ITO layers of Examples 7 to 9 than with the layer of Example 6. This is related to the surface roughness of the transparent magnetic oxide layer, i.e. because of the surface roughness an extremely thin layer of sputter-deposited ITO is less effective. Improvements in the surface roughness of the transparent magnetic oxide layer will permit the use of thinner sputter-deposited metal oxide layers.

As hereinabove described, the use of sputter-deposited metal oxide layers has many advantages, including the ability to form layers with excellent transparency that adhere well to a variety of supports and the ability to eliminate the use of organic solvents. A further important advantage is the ability to coat an extremely thin sputter-deposited metal oxide layer that overlies the transparent magnetic layer. Imaging elements that include a transparent magnetic layer utilize relatively small amounts of the magnetic particles and thus have relatively low signals. Under such circumstances, any increase in head spacing, i.e., the spacing between the magnetic head and the transparent magnetic layer, degrades the signal. Metal oxide layers of the particle/binder type are typically much thicker than the sputter-deposited metal oxide layers described herein and thus require much more head spacing which results in a less effective signal. Also, metal oxide layers of the particle/binder type tend to be hazy unless they are overcoated. If this type of metal oxide layer is coated under the magnetic layer, the presence of the magnetic layer will help with the haze problem by filling in voids and surface roughness. However, if a metal oxide layer of the particle/binder type is employed as a top layer, this benefit is not obtained and an additional coating may be needed to reduce haze. This problem of haze attributable to voids and surface roughness is entirely avoided by use of the sputter-deposited metal oxide layers of this invention and such sputter-deposited layers can be used as the top layer with no need for an additional coating.

The invention has been described in detail, with particular reference to certain preferred embodiments thereof, but it should be understood that variations and modifications can be effected within the spirit and scope of the invention.

We claim:

1. An imaging element for use in an image-forming process; said imaging element comprising a support, an image-forming layer, a transparent magnetic layer comprising magnetic particles dispersed in a film-forming binder and a transparent electrically-conductive layer comprising a sputter-deposited layer of a metal oxide.

2. An imaging element as claimed in claim 1, wherein said sputter-deposited layer of metal oxide has a thickness of less than 50 nanometers.

3. An imaging element as claimed in claim 1, wherein said sputter-deposited layer of metal oxide has a thickness of less than 15 nanometers.

4. An imaging element as claimed in claim 1, wherein the coverage of magnetic particles in said transparent magnetic layer is in the range of from about 0.001 to about 10 g/m$^2$.

5. An imaging element as claimed in claim 1, wherein the coverage of magnetic particles in said transparent magnetic layer is in the range of from about 0.01 to about 1 g/m$^2$.

6. An imaging element as claimed in claim 1, wherein said transparent magnetic layer overlies said transparent electrically-conductive layer.

7. An imaging element as claimed in claim 1, wherein said transparent electrically-conductive layer overlies said transparent magnetic layer.

8. An imaging element as claimed in claim 1, wherein said transparent magnetic layer and said transparent electrically-conductive layer are on opposite sides of said support.

9. An imaging element as claimed in claim 1, wherein said transparent magnetic layer is interposed between image-forming layers.

10. An imaging element as claimed in claim 1, wherein said metal oxide is indium tin oxide.

11. An imaging element as claimed in claim 1, wherein said metal oxide is zinc oxide.

12. An imaging element as claimed in claim 1, wherein said transparent magnetic layer has a thickness in the range of from about 0.05 to about 10 micrometers.

13. An imaging element as claimed in claim 1, wherein said magnetic particles are cobalt-modified gamma-iron oxide particles.

14. An imaging element as claimed in claim 1, wherein said transparent magnetic layer includes as an abrasive particle non-magnetic inorganic powder with a Mobs scale hardness of at least 6 and an average diameter of from about 0.04 to about 0.4 μm.

15. An imaging element as claimed in claim 1, wherein said transparent magnetic layer includes as an abrasive particle non-magnetic inorganic powder with a Mohs scale hardness of at least 8 and an average diameter of from about 0.06 to about 0.35 μm.

16. An imaging element as claimed in claim 1, wherein said image-forming layer is a silver halide emulsion layer.

17. An imaging element as claimed in claim 1, wherein said support is a cellulose acetate film.

18. An imaging element as claimed in claim 1, wherein said support is a poly(ethylene terephthalate) film or a poly(ethylene naphthalate) film.

19. An imaging element as claimed in claim 1, comprising a latex subbing layer overlying said transparent electrically-conductive layer.

20. An imaging element as claimed in claim 1, comprising a layer overlying said transparent electrically-conductive layer that is comprised of a terpolymer of acrylic acid, vinylidene chloride and acrylonitrile.

* * * * *